US005845513A

United States Patent [19]

Fornasari

[11] Patent Number: 5,845,513

[45] Date of Patent: Dec. 8, 1998

[54] ONE-MOTOR DEVICE FOR OPERATING THE STIRRER AND THE CUP OF WATER IN A MACHINE FOR THE PRODUCTION OF ICE CUBES

[75] Inventor: Paolo Fornasari, Cordenons, Italy

[73] Assignee: Castel Mac S.p.A., Castelfranco Veneto, Italy

[21] Appl. No.: 808,877

[22] Filed: Feb. 28, 1997

[30] Foreign Application Priority Data

Mar. 6, 1996 [IT] Italy ..... MI96A0433

[51] Int. Cl.[6] ..... F25C 1/20

[52] U.S. Cl. ..... 62/353; 62/68

[58] Field of Search ..... 62/68, 353, 352

[56] References Cited

U.S. PATENT DOCUMENTS 4,199,956 4/1980 Lunde ..... 62/352

4,207,750 6/1980 Simkens ..... 62/352

5,425,243 6/1995 Sanuki et al. ..... 62/353

*Primary Examiner*—William E. Tapoloal

*Attorney, Agent, or Firm*—Quarles & Brady

[57] ABSTRACT

There is described a device that proceeds to operate the stirrer and the cup for containing the water in a machine for the production of ice cubes. The device comprises a single motor that gives motion to a first rotating shaft operated in a continuous manner and to a second rotating shaft operated in a discontinuous manner. The first rotating shaft is connected to the stirrer by first motion transmission means suitable for converting the rotation of said first shaft into an alternating oscillatory movement of the stirrer. The second rotating shaft is in turn connected to the bowl of water by second motion transmission means suitable for converting the rotation of said second shaft into a corresponding motion of tipping the bowl over.

14 Claims, 8 Drawing Sheets

FIG.7
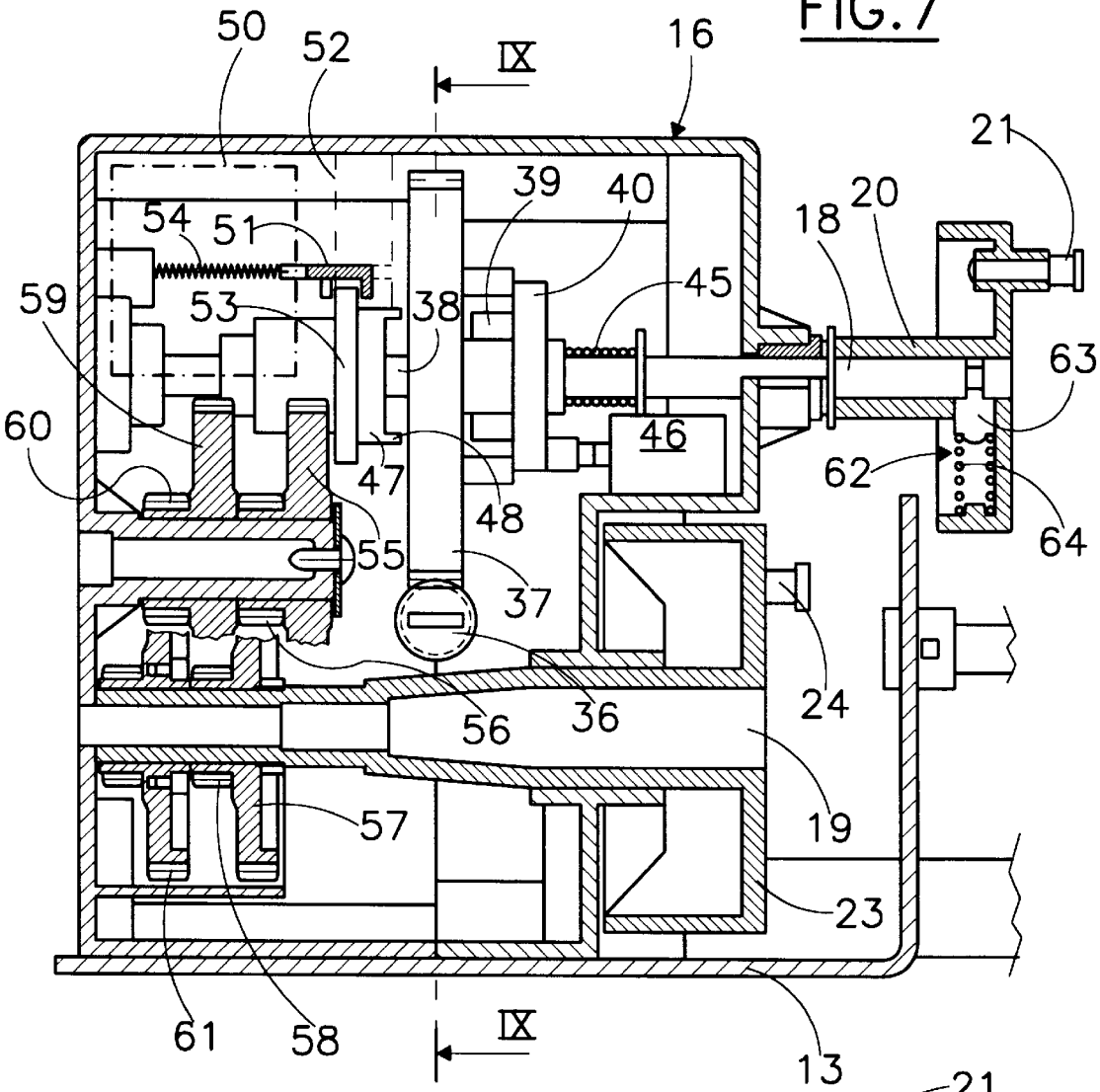
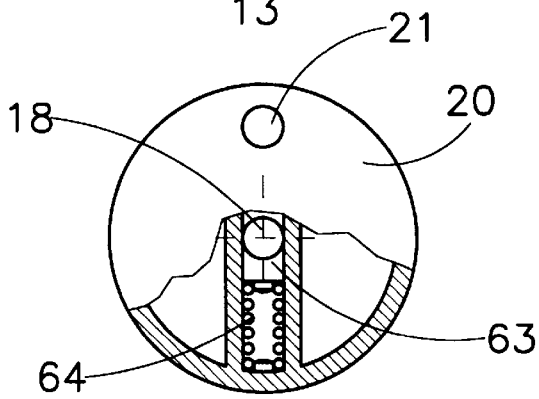
FIG.8

ONE-MOTOR DEVICE FOR OPERATING THE STIRRER AND THE CUP OF WATER IN A MACHINE FOR THE PRODUCTION OF ICE CUBES

The present invention relates to a one-motor device for operating the stirrer and the cup of water in a machine for the production of ice cubes.

Machines for the production of ice cubes are known that comprise substantially an evaporator supplied by a refrigeration unit and provided with parallel tangs extending downward, a tip-over bowl destined to contain a water bath wherein the abovementioned tangs are normally immersed and a stirrer with parallel paddles to keep the water contained in the bowl stirred.

During the normal operation of the refrigeration unit the exchange of heat between the evaporator and the water in the bowl causes the formation of ice cubes round the lower ends of the tangs. When the cubes have attained a predetermined dimension, an appropriate sensor causes the reversal of the refrigeration cycle and the tipping of the bowl for the subsequent detachment of the ice cubes from the tangs and their drop, separated from the water in the bowl by a grille, into an underlying chamber that acts as a chamber for the collection and withdrawal of the cubes.

In the machines currently on the market the movement of the stirrer and the tipping-over of the bowl are operated by a device with two separate and independent motors, that intervene at appropriate moments during the execution of the cycle for the production of the cubes.

The use of two motors is obviously a source of encumbrance and cost, which the user would gladly do without.

The object of the present invention is thus to provide an operating device for a machine for the production of ice cubes, that uses a single motor for operating the movement of the stirrer and of the water bowl.

According to the invention such object is attained with a device characterized in that it comprises a single motor, a first rotating shaft operated in a continuous manner by said motor and connected to the stirrer by first motion transmission means suitable for converting the rotation of said first rotating shaft into an alternating oscillatory motion of the stirrer, a second rotating shaft operated in a discontinuous manner by said motor and connected to the bowl of water by second motion transmission means suitable for converting the rotation of said second shaft into a corresponding motion of tipping the bowl over.

Preferably the discontinuous rotation of the second shaft is operated by the motor through a first clutch unit operated so as to connect said second shaft to the motor only at the end of each cycle of formation of ice cubes.

Again preferably, said first clutch unit is operated by an electromagnet, that is in turn operated to intervene by means for the detection of the dimensions of the cubes that are being formed.

The abovementioned detection means in turn consist preferably of a second clutch unit with oblique teeth, that is interposed between the motor and the first rotating shaft and reacts to the presence of cubes of the maximum predetermined dimensions so as to change their own position until a microswitch or other means for operating the electromagnet are triggered.

Lastly, between the first rotating shaft and the corresponding first motion transmission means there is preferably provided a clutch suitable for allowing the temporary disengagement of the motion transmission means of the rotating shaft in case the stirrer meets an obstacle such as to block its rotation.

The features of the present invention will be better understood making reference to the enclosed drawings, wherein:

FIG. 7 shows the motor unit of the two operating mechanisms of FIGS. 3 and 4–6, sectioned along the line VII—VII of FIG. 4;

FIG. 8 shows a detail of FIG. 7, partially in a side view and partially in a cross-section;

Figure 1:
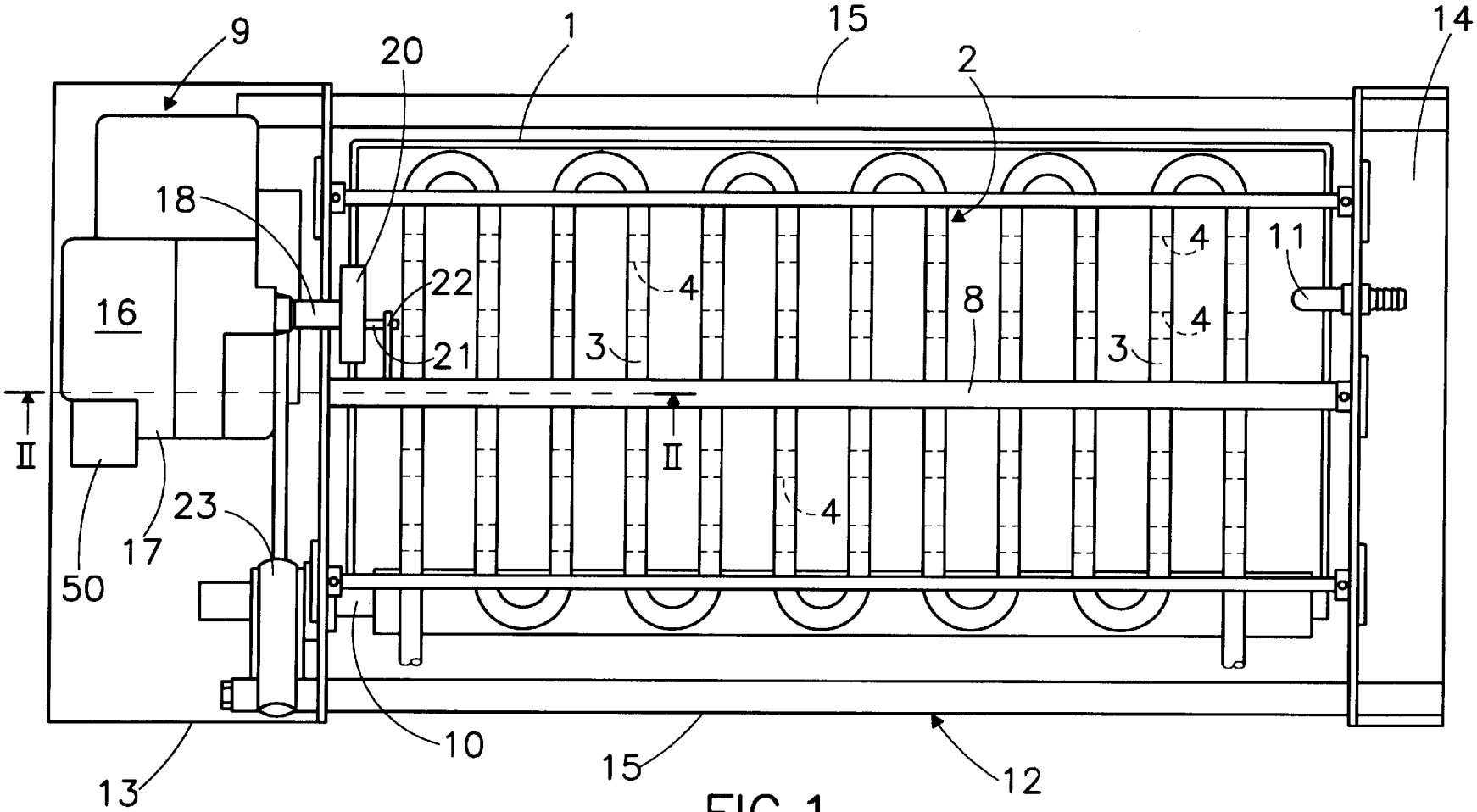
FIG. 1 shows a plan view from above of a machine for the production of ice cubes that is provided with a device according to the invention for operating the stirrer and the bowl of water.

There is represented in the drawings a machine for the production of ice cubes, that comprises a tip-over bowl 1 for containing the water necessary for the formation of the ice, a refrigeration evaporator 2 connected to a refrigeration unit (not shown) and consisting of a plurality of parallel branches 3, each provided with vertical tangs 4 that extend downward and are normally immersed in the water of the bowl 1, a stirrer 5 formed by series of oscillating stirrer paddles 6 (FIGS. 2 and 3) that extend downward from a support band 7 fastened to a horizontal shaft 8 with a square cross-section superimposed over the bowl 1 and a device 9 for driving the alternating rotation of the shaft 8, and thus of the stirrer 5, and the momentary rotation of another horizontal shaft 10 with a square cross-section for tipping over the bowl 1.

The unit just described, together with a small pipe 11 for delivering the water to the bowl 1, is wholly supported by a metal frame 12, consisting of two terminal shoulders 13 and 14 with an L-shaped cross-section and of a pair of metal connecting beams 15, whose length varies with the longitudinal dimensions of the machine.

The driving device 9 is wholly supported by the shoulder 13 and comprises a motor unit 16 provided with a containment casing 17, from which there extend parallel to the axes of rotation of the stirrer 5 and of the bowl 1 two horizontal shafts 18 and 19 (FIG. 7), that are made to rotate, the first in a continuous manner and the second in a discontinuous manner, through respective motion transmission means, as will be made clear later.

Figure 2:
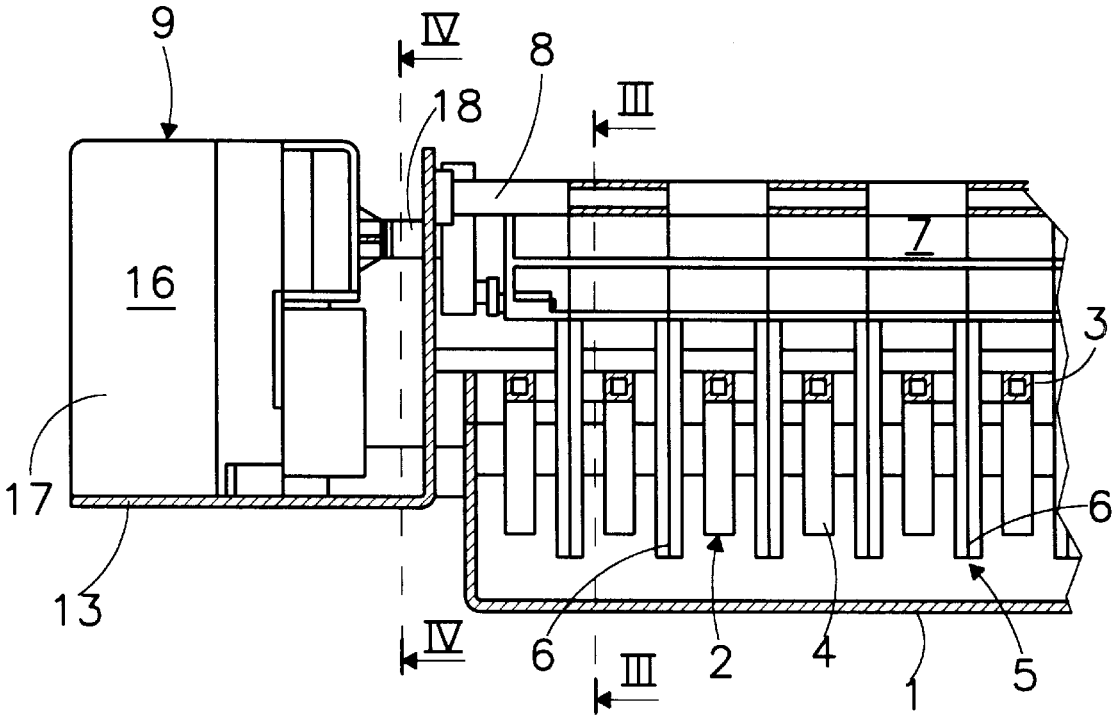
FIG. 2 shows the abovementioned machine in a longitudinal cross-section taken along the line 11—11 of FIG. 1.
Figure 3:
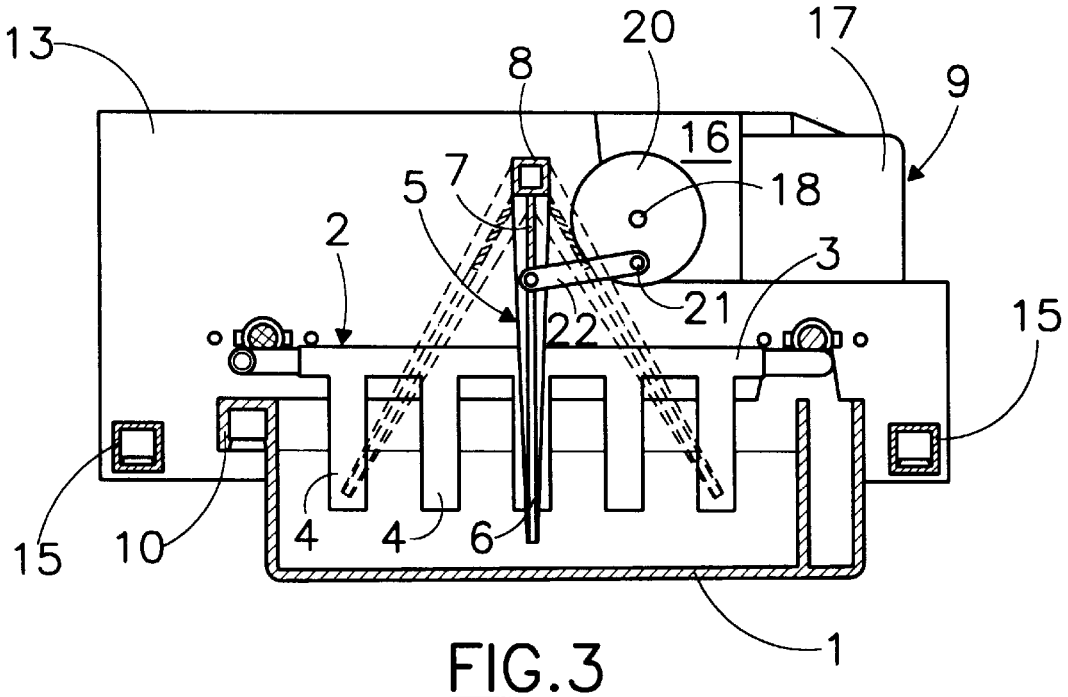
FIG. 3 is transversal cross-section taken along the line III—III of FIG. 2, that shows the operating mechanism of the stirrer.

As shown in FIGS. 1–3, the shaft 18 carries a first disc 20 provided with an eccentric button 21, that is connected through a small connecting rod 22 to the support band 7 of the paddles 8 of the stirrer 5 to convert the continuous rotary motion of the disc 20 into a oscillatory motion of the stirrer 5 round the axis of the shaft 8.

Figure 4:
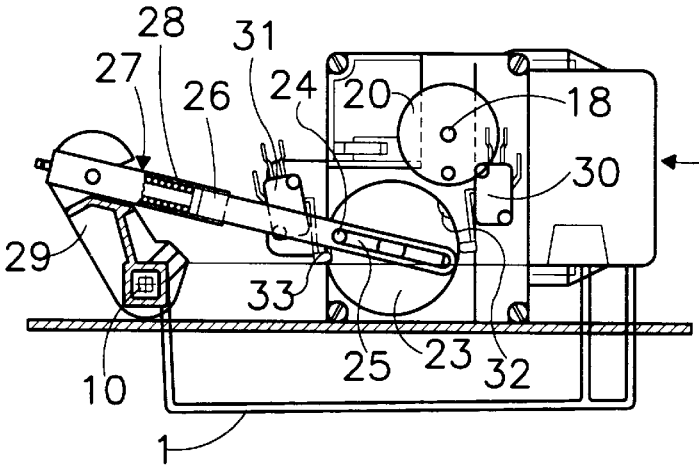
FIG. 4 shows a further transversal cross-section taken along the line IV—IV of FIG. 2, that shows the operating mechanism of the bowl of water under normal operative conditions.
Figure 5:
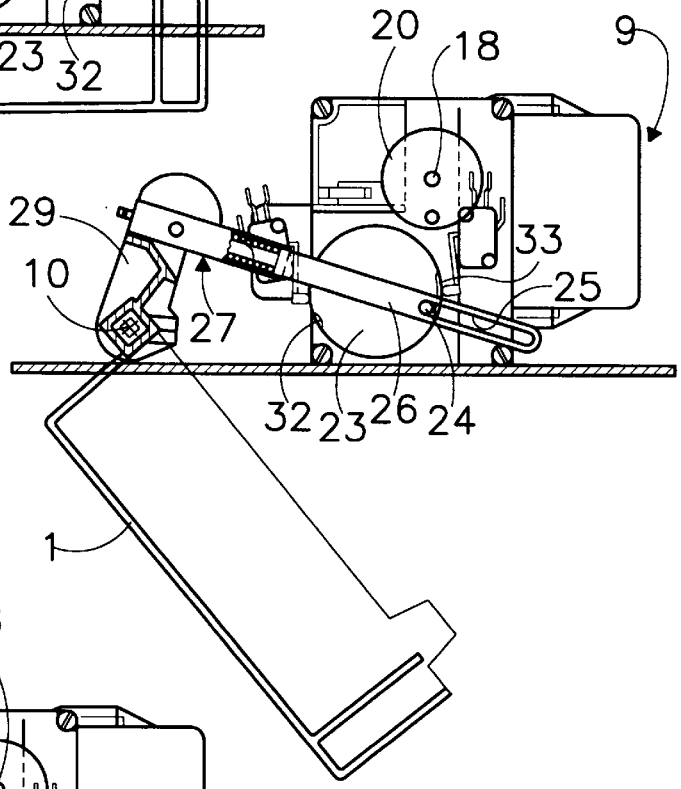
FIGS. 5 and 6 are cross-sections similar to that of FIG. 4 that show different situations during the step when the bowl is tipped over.
Figure 6:
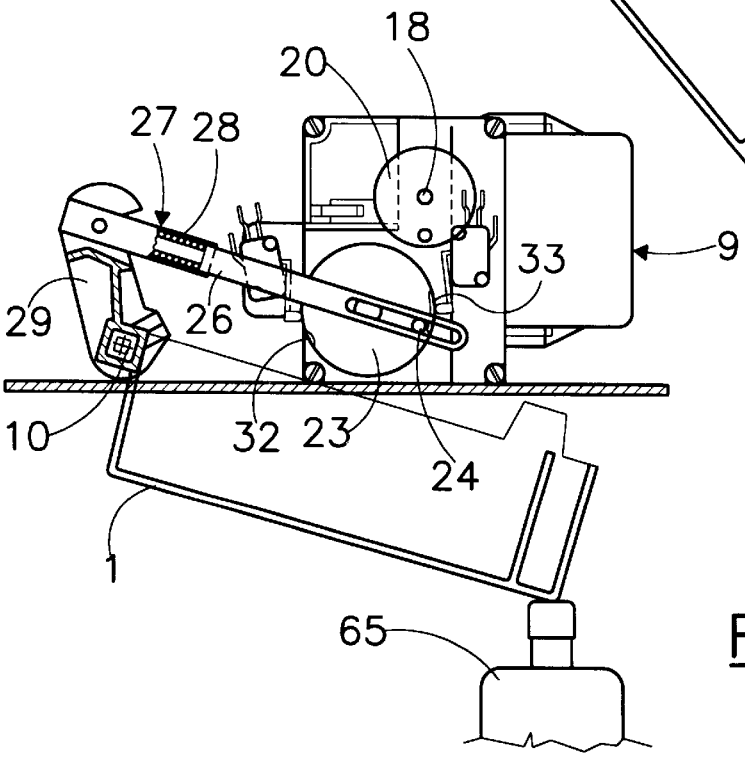

But as shown on the other hand in FIGS. 4–6, the shaft 19 carries a second disc 23 provided with an eccentric button 24, that is engaged in a longitudinal slot 25 of a rod 26, that through a sliding joint 27 with a preloaded compensating spring 28 operates the rotation of a lever 29 rigidly mounted on the shaft 10 for operating the tipping over of the bowl 1.

Two microswitches 30 and 31 fastened to the casing 17 co-operate with peripheral notches 32 and 33 of the disc 23 for the purposes that will be explained later.

As shown in FIGS. 7–12, the motor unit 16 comprises in the first place an electric motor 34 (FIG. 8), from which there extends a driving shaft 35 that carries a worm gear 36 engaged with a helical wheel 37 keyed on a pivot 38 aligned but not integral with the shaft 18.

The rotatory coupling between the helical wheel 37 and the continuous-motion shaft 18 (FIGS. 10–12) is by means of a clutch unit consisting of a drum 39 fastened on the shaft 18 and normally rotatable together with a disc 40 mounted rotatably and slidably on the shaft 18 and having legs 41 slidably inserted in guides 42 of the helical wheel 37 (FIG. 11) so that the disc 40 is obliged to rotate with the wheel 37 while being able to move axially with respect to it. The drum 39 and the disc 40 are connected one with the other by a frontal clutch with oblique teeth 43 and 44, respectively, shown in FIGS. 10–12, that is maintained by a calibrated spring 45 and allows, in case of rotation of the helical wheel 37 not accompanied by an equal rotation of the shaft 18, to cause the disc 40 to slide axially for the consequent operation of a microswitch 46, whose purposes will be made clear later.

Figure 9:
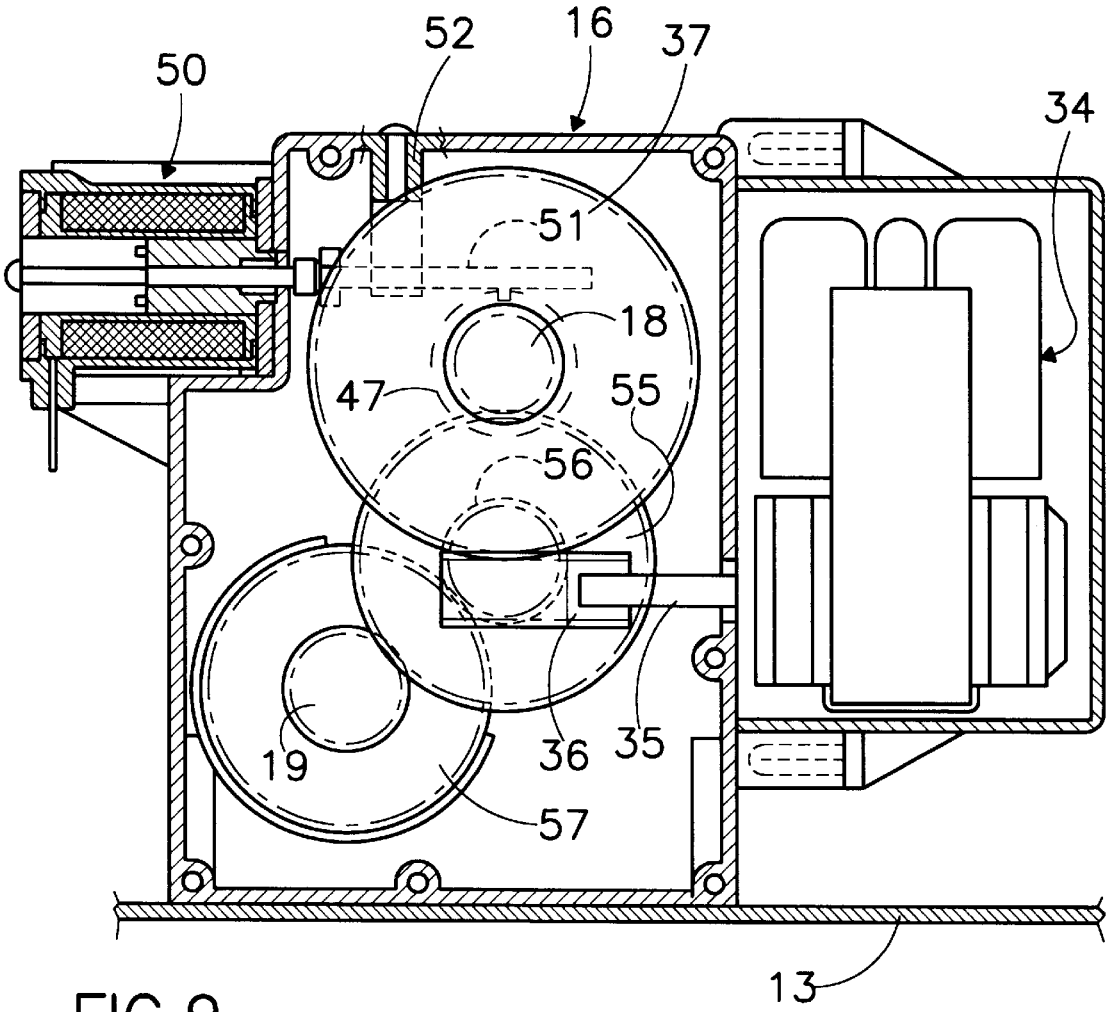
FIG. 9 shows the same motor unit in a diagrammatic transversal cross-section taken along the line IX—IX of FIG. 7.
Figure 11:
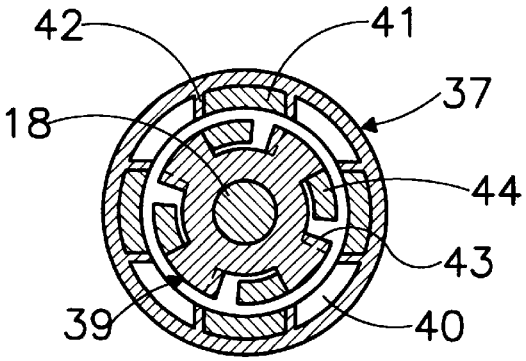
FIG. 11 shows a detail of the abovementioned motor unit in an enlarged transversal cross-sectional view taken along the line XI—XI of FIG. 10.
Figure 10:
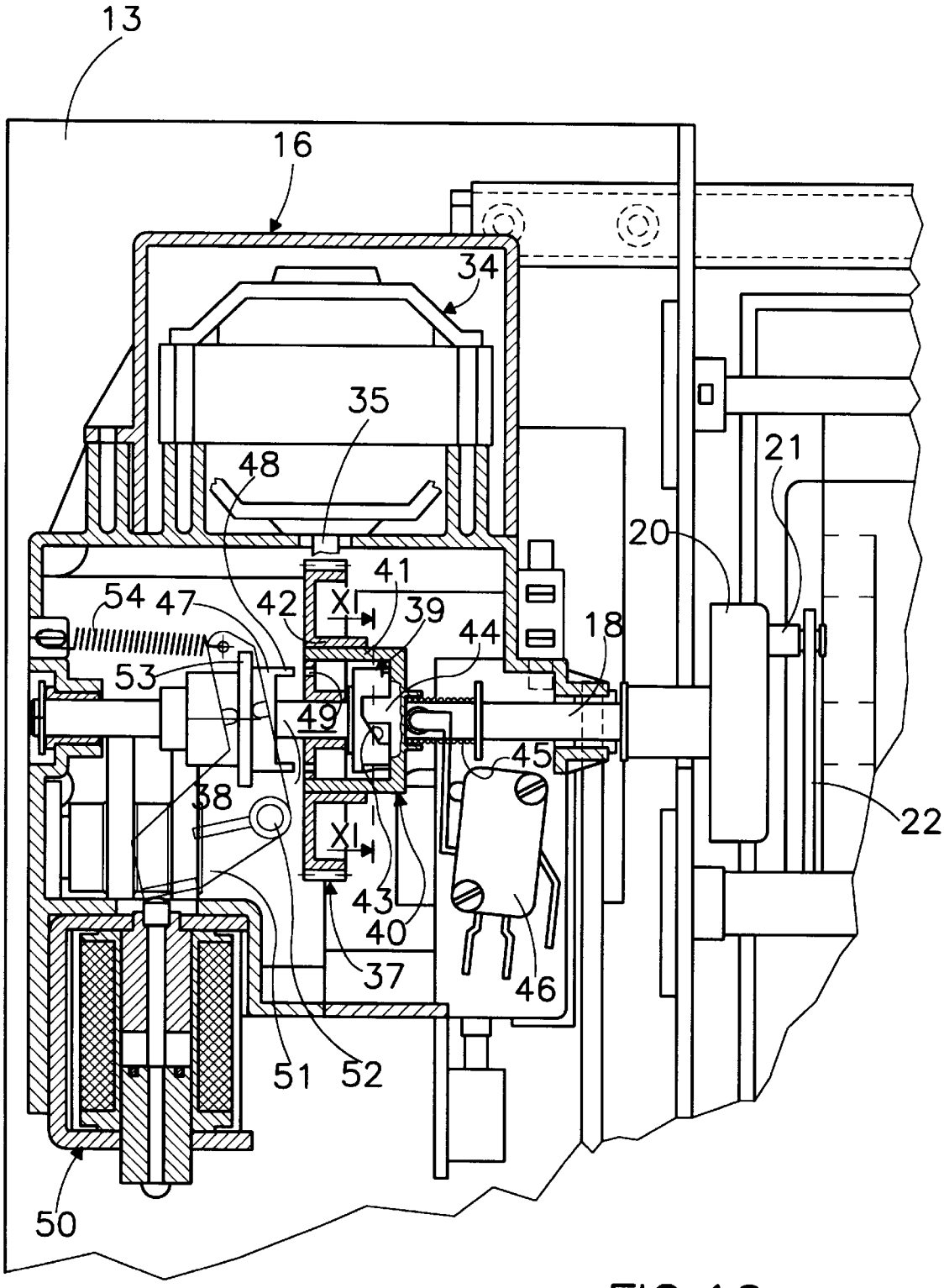
FIG. 10 is a partially sectioned plan view, that shows said motor unit under normal operative conditions.
Figure 12:
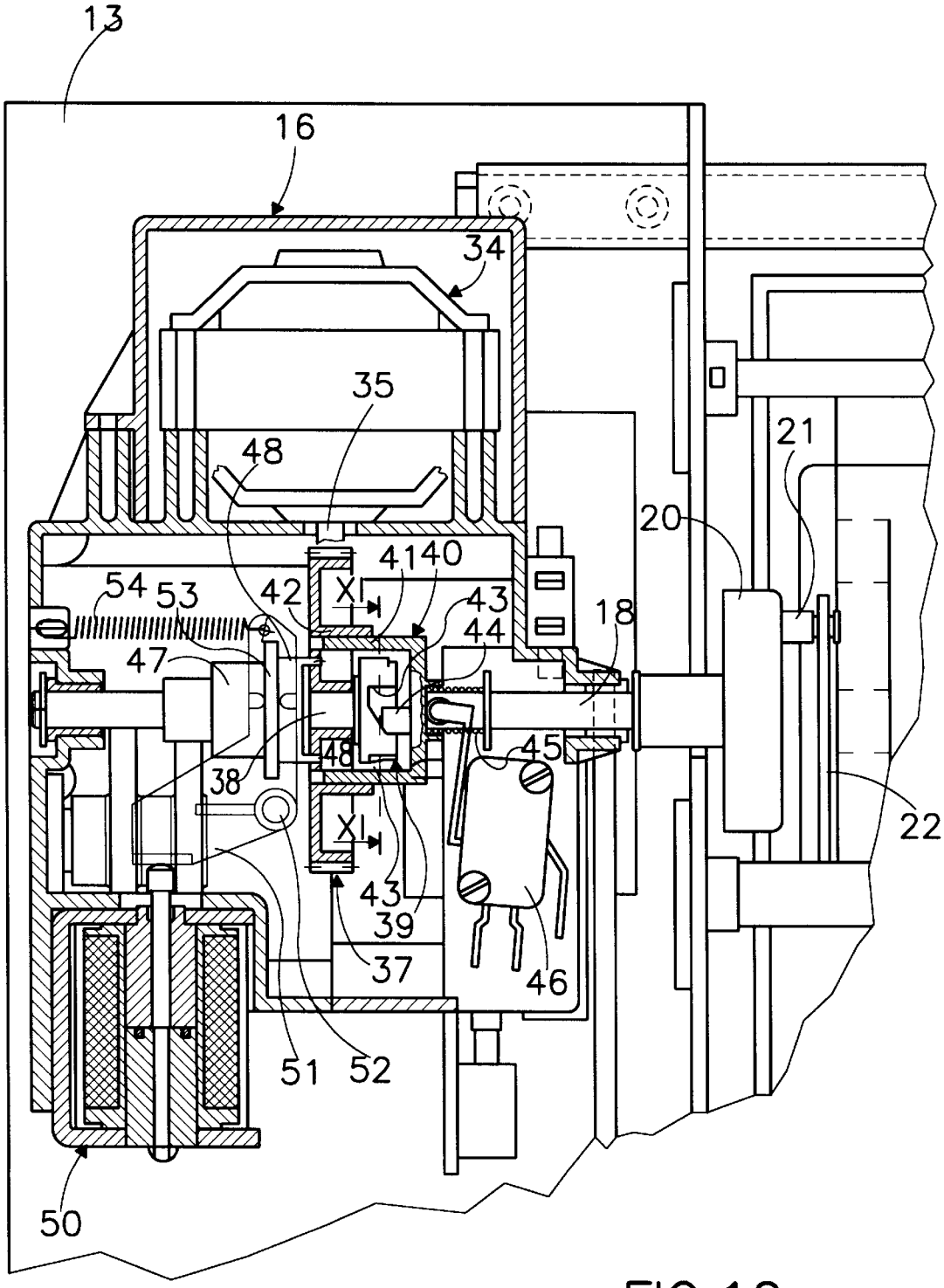
FIG. 12 is a partially sectioned plan view similar to that of FIG. 10, that shows said motor unit during the step when the bowl is tipped over.

The rotatory coupling between the helical wheel 37 and the shaft 19 with a discontinuous motion is in turn made by means of a clutch unit consisting of a pinion 47 mounted in a rotatable and axially slidable manner on the pivot 38 and connectable for rotation to the helical wheel 37 by means of the insertion of two front teeth 48 of the pinion 47 in corresponding holes 49 of the wheel 37 (FIGS. 10 and 12). The engagement and disengagement of the teeth 48 takes place by means of the axial sliding motion of the pinion 47, operated by an electromagnet 50 through a lever 51 pivoted at 52 and acting on a radially protruding collar 53 of the pinion 47 (FIGS. 7, 9, 10 and 12).

A spring 54 normally holds the lever 51 in the at rest position of FIG. 10, wherein the teeth 48 of the pinion 47 are outside the holes 49 of the helical wheel 37 and the pinion 47 is thus disengaged from the latter.

The displacement of the lever 51 from the abovementioned at rest position is operated by the excitation of the electromagnet 50, that thus has the task of determining the rotational engagement of the pinion 47 with the helical wheel 37, as shown in FIG. 12.

Due to such rotational engagement the pinion 47 can thus transmit the motion, suitably slowed-down, to the discontinuous rotating shaft 19 through a gear train 55-61 illustrated in FIGS. 7 and 9.

Lastly the driving device 9 is completed by a clutch unit 62 interposed between the continuous rotating shaft 18 and the disc 20 and consisting of a cylinder 63 slidably housed in a radial cavity of the disc 20 and urged by a spring 64 toward a position of friction up against the shaft 18 (FIGS. 7 and 8).

The machine illustrated in FIGS. 1–12 operates as follows in relation to a cycle of formation of ice cubes.

With the bowl 1 positioned as in FIG. 4 and suitably filled with water, the electromagnet 50 disexcited and the pinion 47 therefore arranged in a position of disengagement as in FIG. 10, the motor 34 triggered so as to cause the alternating rotation of the stirrer 5 (FIG. 3) and the refrigeration unit activated so as to allow the evaporator 2 to remove heat from the surrounding environment, respective ice cubes are formed on the lower ends of the tangs 4.

During this step, if an obstacle of whatsoever nature were to prevent the rotation of the stirrer, the clutch unit 62 would intervene to separate the disc 20 from the shaft 18, that would continue to rotate even with the disc at a standstill without creating any problems for the motor unit 16.

When the cubes attain pre-established dimensions, the oscillation of the paddles 6 of the stirrer 5 is braked by the walls of the cubes. The oblique co-operating teeth 43 and 44 of the clutch unit formed by the drum 39 and by the disc 40 then intervene to determine a limited axially sliding motion of the disc 40 (FIG. 12), that causes the commutation of the microswitch 46 in a position such as to operate the excitation of the electromagnet 50 and the reversal of the cycle of the refrigeration unit.

As a consequence, the pinion 47 goes to engage with the helical wheel 37 so as to drive through the gear train 55-61 and the motion transmission unit consisting of the disc 23, of the eccentric 24, of the rod 26 with slot 25 and of the lever 29 the rotation of the bowl 1 to the tipped-over position of FIG. 5.

The rotation of the bowl is made to continue by the disengagement of the microswitch 30 from the notch 33 of the disc 23.

Were the rotation of the bowl 1 to be prevented by an obstacle such as, for example, a small bottle such as that indicated with 65 in FIG. 6, the sliding motion of the eccentric 24 along the slot 25 would prevent any damage to the motion transmission unit.

Due to the reversal of the refrigeration cycle and of the tipping-over of the bowl, the cubes become detached from the tangs 4 of the evaporator 2 and, separated from the water of the bowl by means of a grille (not shown), fall in an underlying collection chamber (not shown), where they are accumulated for the subsequent withdrawal. Immediately afterwards, while the clutch unit formed by the drum 39 and by the disc 40 has by now returned to the at rest position of FIG. 10, the bowl 1, the disc 23 continuing to rotate, is taken back to the normal operative position of FIG. 4, set by the engagement of the microswitch 31 with the notch 33 of the disc 23, that determines the end of the reversal of the refrigeration cycle and also the disexcitation of the electromagnet 50.

The engagement and disengagement of the microswitch 30 with the notch 32 of the disc 23 allow, as an alternative to what has been described, to obtain an advance of the end of the reversal cycle (and thus a shorter duration of the step of the reversed cycle) with respect to the moment when the bowl returns to the normal operative position.

The bowl is then filled with water and on the lower immersed ends of the tangs of the evaporator 2 the ice cubes start to form again. It should be noted that the bowl 1 is kept in the position of FIG. 4 in spite of the weight of the water thanks to the preloading of the spring 28.

Figure 13:
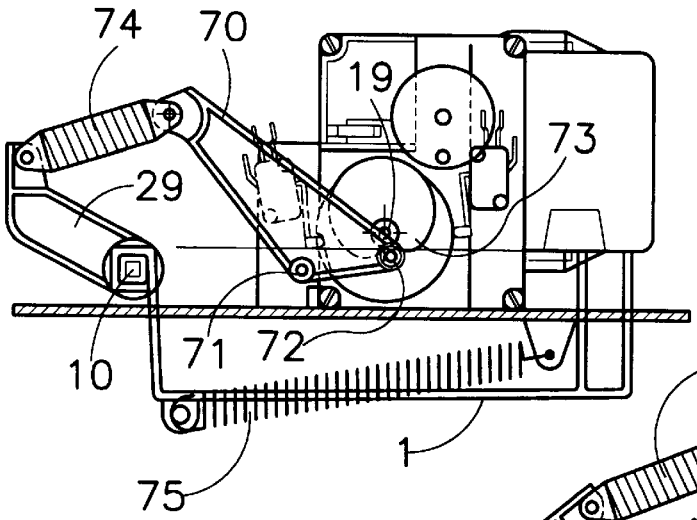
FIGS. 13–15 are views similar to those of FIGS. 4–6, that show a variant of the operating mechanism of the bowl of water.
Figure 14:
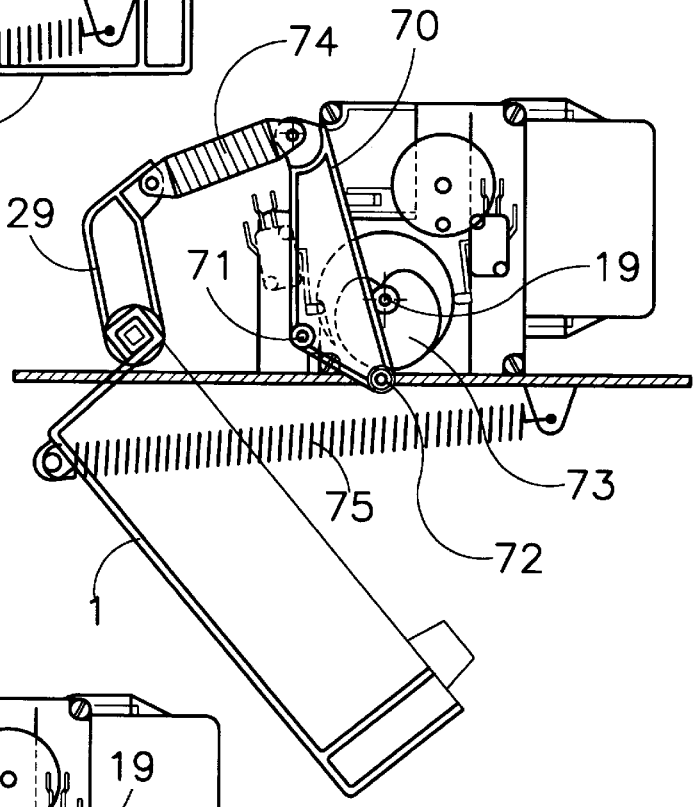
Figure 15:
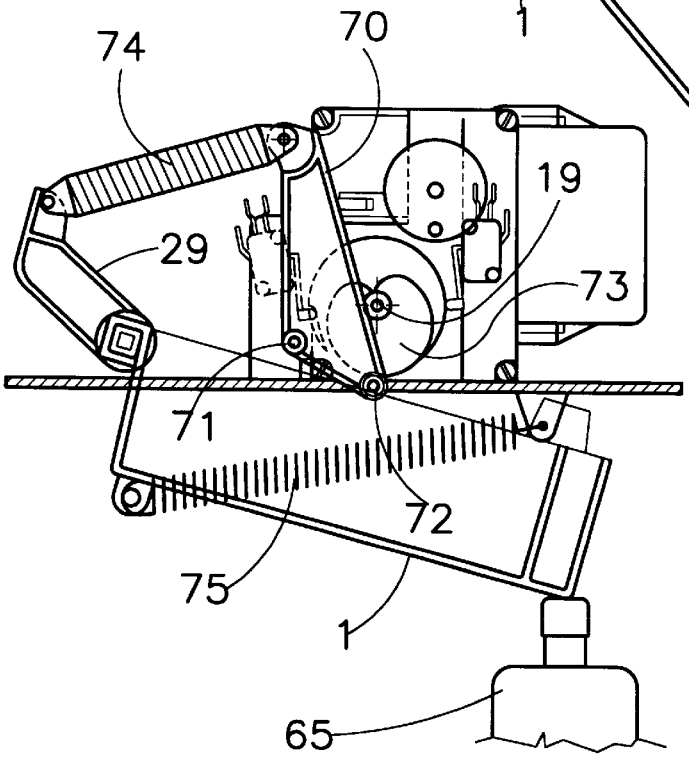

There is illustrated in FIGS. 13–15 a motion transmission unit for the bowl 1, that can be used as an alternative to that of FIGS. 4–6 in the case wherein a speed of opening the bowl is required that is less than the speed of closing it. Instead of the rod 26 with elastic joint 27 and slot 25 engaged with the eccentric 24 there is a lever 70 hinged at 71 and supporting a roller 72 engaged with a shaped cam 73 that rotates together with the shaft 19. A compensating spring 74 connects the lever 70 with the lever 29 for the same purpose of the spring 28 of FIG. 4, that is to prevent damage to the mechanism in case it hits an obstacle such as a bottle 65 (FIG. 15). A further spring 75 normally holds the bowl 1 in the at rest position of FIG. 13, extending during the step wherein the bowl is tipped over (FIG. 14).

I claim:

1. A device for operating a machine for the production of ice cubes comprising an evaporator supplied by a refrigeration unit and provided with parallel tangs extending downward, a tip-over bowl destined to contain a water bath wherein the abovementioned tangs are normally immersed and a stirrer with parallel paddles to keep the water contained in the bowl stirred, comprising a single motor, a first rotating shaft operated in a continuous manner by said motor and connected to the stirrer by first motion transmission means suitable for converting the rotation of said first rotating shaft into an alternating oscillatory motion of the stirrer, a second rotating shaft operated in a discontinuous manner by said motor and connected to the bowl of water by second motion transmission means suitable for converting the rotation of said second shaft into a corresponding motion of tipping the bowl over.

2. A device according to claim 1, further comprising a first clutch unit operated so as to connect said second shaft to the motor only at the end of each cycle of formation of ice cubes.

3. A device according to claim 2, said first clutch unit consisting of a pinion that is rotatably mounted on a supporting shaft made to rotate in a continuous manner by said motor and can be operated to engage for rotation with said supporting shaft to transmit the motion from said supporting shaft to said second rotating shaft.

4. A device according to claim 3, said pinion being mounted slidably on said supporting shaft and is provided with front teeth that can engage as a result of an axial sliding motion operated by said pinion in corresponding holes of a driven wheel fastened on said supporting shaft and taken in rotation by said motor.

5. A device according to claim 4, the axial sliding motion of said pinion being operated by an electromagnet driven by means for detecting the dimensions of the cubes that are being formed.

6. A device according to claim 5, said detection means comprises a second clutch unit, that is interposed between the motor and the first rotating shaft and reacts to the presence of cubes of the maximum predetermined dimensions so as to change their own position until an electric means is triggered that operates the electromagnet.

7. A device according to claim 6, said second clutch unit comprising a drum fastened on said first rotating shaft and a disc mounted rotatably and slidably on said first shaft and engaged with said driven wheel so as to be obliged to rotate with said wheel while being able to move axially with respect to it, said drum and said disc being connected one with the other by a frontal clutch with oblique teeth, that is maintained by a calibrated spring and allows, in case of rotation of said driven wheel not accompanied by an equal rotation of said first shaft, to cause said disc to slide axially for the consequent operation of said electric means.

8. A device according to claim 1, further comprising a clutch unit interposed between said first rotating shaft and said first motion transmission means to allow their temporary disengagement in case the stirrer meets an obstacle such as to block its rotation.

9. A device according to claim 1, said first motion transmission means comprising a first rotating disc mounted on said first rotating shaft and provided with an eccentric button and a small connecting rod between said eccentric button and a supporting shaft of said stirrer.

10. A device according to claim 9, comprising a clutch unit interposed between said first rotating shaft and said first motion transmission means to allow their temporary disengagement in case the stirrer meets an obstacle such as to block its rotation, said clutch unit comprising a cylinder slidably housed in a radial cavity of said first rotating disk and elastically urged toward a position of friction up against said first rotating shaft.

11. A device according to claim 1, said second motion transmission means comprising a second rotating disc rotatable together with said second rotating shaft and provided with an eccentric button engaged in a longitudinal slot of a rod for connecting to a lever for operating the rotation of the bowl.

12. A device according to claim 11, further comprising a preloaded compensating spring interposed between said rod and said lever.

13. A device according to claim 1, said second motion transmission means comprising a shaped cam rotatable together with said second rotating shaft and a lever with a fixed fulcrum provided with a cam follower engaged with said cam and connected to a lever for operating the rotation of the bowl.

14. A device according to claim 11, further comprising a preloaded compensating spring interposed between said rod with a fixed fulcrum and said operating lever.

* * * * *